US007849546B2

(12) United States Patent
Wieland

(10) Patent No.: US 7,849,546 B2
(45) Date of Patent: Dec. 14, 2010

(54) MEMBRANE SPRING ARRAY FOR A MATTRESS AND A METHOD OF ASSEMBLY OF A MEMBRANE SPRING ARRAY

(75) Inventor: Rainer Wieland, Venice, CA (US)

(73) Assignee: Somnium, Inc., Venice, CA (US)

( * ) Notice: Subject to any disclaimer, the term of this patent is extended or adjusted under 35 U.S.C. 154(b) by 0 days.

(21) Appl. No.: 12/101,888

(22) Filed: Apr. 11, 2008

(65) Prior Publication Data

US 2008/0189868 A1 Aug. 14, 2008

(51) Int. Cl.
*A47C 23/04* (2006.01)

(52) U.S. Cl. ..... 5/719; 5/247; 267/164

(58) Field of Classification Search ..... 5/719, 5/247, 255, 253, 261, 716; 267/89, 103, 267/105, 110, 164
See application file for complete search history.

(56) References Cited

U.S. PATENT DOCUMENTS

| | | | | |
|---|---|---|---|---|
| 5,395,097 | A | 3/1995 | Dabney et al. | |
| 5,401,007 | A | 3/1995 | Dabney et al. | |
| 5,632,473 | A * | 5/1997 | Dias Magalhaes Queiroz | 267/164 |
| 5,787,533 | A | 8/1998 | Fromme | |
| 6,113,082 | A | 9/2000 | Fujino | |
| 6,182,315 | B1 | 2/2001 | Lee | |
| 6,427,990 | B1 * | 8/2002 | Hartmann | 267/158 |
| 6,477,727 | B1 | 11/2002 | Fromme | |
| 6,721,982 | B2 | 4/2004 | Freeman | |
| 6,826,791 | B2 | 12/2004 | Fromme | |
| 6,994,333 | B2 * | 2/2006 | Lobry et al. | 267/145 |

FOREIGN PATENT DOCUMENTS

| | | |
|---|---|---|
| AT | 8325 | 6/2006 |
| WO | WO 2005084495 A1 * | 9/2005 |

OTHER PUBLICATIONS

WO 2005084495 machine translation.*

* cited by examiner

*Primary Examiner*—Robert G Santos
*Assistant Examiner*—Brittany M Wilson
(74) *Attorney, Agent, or Firm*—Marc E. Hankin; Kevin Schraven; Hankin Patent Law, APC

(57) ABSTRACT

Various embodiments of this invention disclose an internal spring array of a mattress wherein the springs are mounted back to back on a membrane, and a simplified method for making an internal spring array of a mattress. The springs of the array have support plates connected to a base section via a spring arm.

5 Claims, 7 Drawing Sheets

MEMBRANE SPRING ARRAY FOR A MATTRESS AND A METHOD OF ASSEMBLY OF A MEMBRANE SPRING ARRAY

FIELD OF INVENTION

This invention generally relates to mattresses. Moreover, it pertains specifically to an internal spring array of a mattress wherein the springs are mounted back to back on a membrane, and a simplified method for making an internal spring array of a mattress. The springs of the array have support plates connected to a base section via a spring arm. This type of spring is known in the art as a Belleville spring.

BACKGROUND

For centuries, people have been sleeping on mattresses to get a more comfortable rest, in order to be elevated off of the floor, and to gain protection from the elements. Several challenges face designers of mattresses including how to provide a reasonably priced high quality mattress, how to provide sufficient ergonomic support, how to reduce the amount of the sleeper's perspiration that is absorbed and retained by the mattress, and how to make the springs of the mattress last longer and provide more comfort. Two common types of mattresses are the metal spring mattress and the foam mattress. Although both the metal spring mattress and the foam mattress provide a more comfortable rest than sleeping on the floor, neither adequately reduces the absorption and retention of moisture and perspiration by the mattress. Moisture and perspiration absorption and retention is bad because dust mites thrive on the moisture and perspiration retained by the mattress. Excessive dust mite dander and waste causes an allergic response in many people. Additionally, metal spring mattresses fatigue from use, start to sag, and become increasingly less comfortable. Metal spring mattresses that are inexpensive do not sufficiently protect the sleeper from pressure points caused by the metal springs. Metal spring mattresses are very heavy and very difficult to move or even flip over. Metal spring mattress cause electromagnetic fields, which can interfere with sleep. There is a need in the art for a mattress that is light, free of metal, ergonomic, comfortable, and allows proper ventilation to reduce the amount of perspiration and moisture that is absorbed and retained by the mattress.

In the field of Belleville springs, some springs have been developed that function as a support system for separate cushions. One such Belleville spring is disclosed by U.S. Pat. No. 6,826,791 to Fromme (hereinafter "Fromme 1"), which discloses a spring element for supporting a seat cushion or a mattress. The Fromme 1 spring elements connect to a rigid platform in an array that supports a separate cushion on which a user sits or sleeps. Although Fromme 1 discloses an optimal type of spring, it fails to disclose attaching these springs back to back on a single contiguous and flexible membrane and inserting the resulting internal spring membrane array into the core of a double-sided mattress. In fact, Fromme 1 specifically recites that the springs, when arrayed on a rigid platform, act similar to a box spring, and not as a mattress core. This is a fundamental difference Another Belleville spring cushion support system is disclosed by U.S. Pat. No. 5,787,533 to Fromme (hereinafter "Fromme 2"), which discloses a cushioning support system for a mattress comprising a plurality of springs forming a grid structure. Fromme 2 specifically discloses and claims a box spring system that supports a foam chair cushion or a mattress. Although Fromme 2 discloses an optimal type of spring, it fails to disclose attaching these springs back to back on a single contiguous and flexible membrane and inserting the resulting internal spring membrane array into the core of a double-sided mattress. In fact, Fromme 2 specifically recites that the springs, when arrayed on a rigid platform, act similar to a box spring, and not as a mattress core.

Another Belleville spring cushion support system is disclosed by U.S. Pat. No. 6,477,727 to Fromme (hereinafter "Fromme 3"), which discloses support structure for a cushion or a mattress comprised of intersecting support structure elements (under-crosses or grid sections) with bearing (spring) elements connected on top. See FIG. 7*a* and Col. 7 lines 29-31. Although Fromme 3 discloses an optimal type of spring, it fails to disclose attaching these springs back to back on a single contiguous and flexible membrane and inserting that internal spring membrane array into the core of a double-sided mattress.

In the area of mattress ventilation systems and structures, several systems and structures have been developed that allow ventilation in an effort to avoid moisture absorption and retention. One such mattress ventilation system is disclosed by U.S. Pat. No. 6,182,315 to Lee, which discloses a three layer nylon and steel fiber mesh structure that is placed on top of a cushion or mattress. Although Lee's structure does promote ventilation, it fails to disclose a mattress with Belleville springs attached back to back on a single contiguous membrane and inserting that internal spring membrane array into the core of a double-sided mattress. Further, Lee's ventilation structure is more concerned with allowing perspiration to evaporate from the user's body, rather than allowing perspiration and moisture to ventilate out of the mattress itself.

In the area of internal cushion layers adjoining a spring layer in mattresses, numerous mattresses feature cushions that enclose a spring core. One such mattress is disclosed by U.S. Pat. No. 6,721,982 to Freeman, which discloses a quilted internal cushion directly adjacent to a spring array core of a mattress. Although Freeman recites a cushion layer or layers that enclose a spring core of a mattress, it fails to disclose a mattress with a core comprised of Belleville springs attached back to back on a single contiguous membrane.

In the field of two spring arrays making up the core of a mattress, several mattresses feature mattresses cores with dual spring arrays. One such mattress is disclosed by U.S. Pat. No. 5,401,007 to Dabney et al. (hereinafter "Dabney 1"), which discloses a wire spring mattress core wherein two separate spring arrays that snap fit together in a front to front connection. The Dabney 1 mattress core specifically recites that each of the spring arrays attaches to a separate grid support. As such, the Dabney 1 mattress core has two separate grid supports and the springs are connected in a face to face manner. Although Dabney 1 discloses a double-sided mattress core with two spring arrays, it does not disclose a non-wire Belleville spring, or springs that are attached back to back on a single grid support. Further, Dabney 1 recites that the base of the springs are adjacent to the enclosing cushioning layers. Thus, Dabney 1 does not disclose a mattress core wherein the distal end of the springs are adjacent to the enclosing cushioning layers.

Another type of dual spring array mattress cores is disclosed by U.S. Pat. No. 5,395,097 to Dabney et al. (hereinafter "Dabney 2"), which discloses a wire spring mattress core wherein two separate spring arrays nestably fit together in a distal end to distal end connection. The Dabney 2 mattress core specifically recites that each of the spring arrays attaches to a separate grid support. As such, the Dabney 2 mattress core has two separate grid supports and the distal end of the springs contact or attach nestably to the base end of opposite grid support. Although Dabney 2 discloses a double-sided mattress core with two spring arrays, it does not disclose a non-wire Belleville spring, or springs that are attached back to back on a single grid support. The reversed orientation of Dabney I or Dabney II is integral to those inventions and it would not be an obvious improvement merely to reverse the orientation because to do so, the entire structure of the mattress would be affected and changed thereby.

In the area of non-wire springs, numerous types have been developed that allow mattresses to be made with non-wire springs. One such non-wire spring is disclosed by U.S. Pat. No. 6,113,082 to Fujino, which discloses a non-wire spring that is shaped similar to traditional wire springs for mattresses. Fujino recites a resin or plastic spring wherein the springs are arrayed parallel between two grid supports. Although Fujino discloses a non-wire spring array inserted into the core of a double-sided mattress, it fails to disclose a Belleville spring, or springs that are attached back to back on a single contiguous membrane.

Thus, there remains a long-felt need in the art for an inexpensive, ergonomic, and comfortable mattress with proper ventilation to reduce the amount of perspiration and moisture that is retained by the mattress. It is also clear that there is a need in the art for a system of quickly and inexpensively assembling an internal spring array for a mattress.

SUMMARY OF THE INVENTION

To minimize the limitations in the prior art, and to minimize other limitations that will become apparent upon reading and understanding the present specification, the present invention discloses an internal spring array of a mattress wherein the springs are mounted back to back on a membrane, a method for making an internal spring array of a mattress, and a mattress with two cover layers that enclose an internal spring array wherein the springs are mounted back to back on a membrane and this spring array is surrounded by a frame layer.

One embodiment of this invention is an internal spring array of a mattress, comprising: a plurality of springs; and a membrane with a plurality of holes. The plurality of springs are mounted on opposite sides of the membrane. The plurality of springs are plastic and comprised of a support plate, a plurality of spring arms, and a base. The plurality of springs can include mounting pins that extends from the base. The plurality of springs are mounted on opposite sides of the membrane by pushing the mounting pins in to the membrane holes. The membrane has a plurality of ventilation apertures.

Another embodiment of this invention is an internal spring array wherein the plurality of springs also has receiving holes in the base. The plurality of springs are mounted on opposite sides of the membrane by pushing the mounting pins through the membrane holes and into the receiving holes. The membrane has a plurality of ventilation apertures.

Another embodiment of this invention is an internal spring array that further comprises a plurality of separate mounting pins. The plurality of springs has one or more receiving holes in the base. The plurality of springs are mounted on the membrane by pushing the mounting pins through the plurality of membrane holes and into the receiving holes. The membrane has a plurality of ventilation apertures.

One embodiment of this invention is a method of assembling an internal spring array of a mattress comprising: placing a plurality of springs with a plurality of receiving holes on opposite sides of a membrane with a plurality of holes; and mounting the plurality of springs by pushing a plurality of mounting pins through the plurality of spring receiving holes and through the plurality of membrane holes. Such a method of assembling an internal spring array wherein the plurality of springs are plastic, and are comprised of a support plate, a plurality of spring arms, and a base.

Another embodiment of this invention is a method of assembling an internal spring array of a mattress comprising: placing a plurality of springs with a plurality of receiving holes and a plurality of mounting pins on opposite sides of a membrane with a plurality of holes; and mounting the plurality of springs by pushing the plurality of spring mounting pins through the plurality of membrane holes and through the plurality of spring receiving holes. Such a method of assembling an internal spring array wherein the plurality of springs are plastic, and are comprised of a support plate, a plurality of spring arms, and a base.

One embodiment of the invention is an internal spring array of a mattress, comprising a plurality of spring portions, and a membrane portion. The plurality of springs are contiguous with and permanently attached to the membrane portion. The internal spring array is plastic. The plurality of spring portions are comprised of a support plate, a plurality of spring arms, and a base. The plurality of spring portions show varying spring flexibility depending on where they are located on said membrane. The membrane portion has a plurality of ventilation apertures.

An object of the present invention is to provide a light weight, ergonomic, and comfortable mattress that will overcome the deficiencies of the prior art.

Another object of the present invention is to provide a mattress that allows proper ventilation to prevent the absorption and retention of moisture and perspiration.

Another object of the present invention is to provide a system of quickly and inexpensively assembling an internal spring array for a mattress.

Another object of the present invention is to provide a light weight, ergonomic, and comfortable internal spring array for a mattress that will overcome the deficiencies of the prior art.

Another object of the present invention is to provide an internal spring array of a mattress that is not made with wire or metal springs that can cause: 1) painful pressure points and prevent muscles from fully relaxing; 2) electromagnetic fields; and 3) the mattress to be excessively heavy.

The present invention is a significant improvement over the usual metal spring mattress. Because the spring core of a usual metal spring mattress cannot distribute the load of a reclining person to the best advantage, the metal springs are connected to two spring supports (one top support and one bottom support) in the form of rigid or flexible latticework. Instead of two spring support latticeworks, an embodiment of the present invention simply connects two Belleville springs together at their bases with each spring mounted on opposing sides of a single contiguous membrane. After being mounted on the membrane, the spring support plates are directed away from the spring base. The support plates then act as a defacto support latticework when they are in flush contact with the cover layer to which they are adjacent. Importantly, the spring support plates, unlike traditional metal springs, need no additional bracing beyond what is provided by the other spring components and the membrane. The membrane is perforated with ventilation apertures, which both reduce the weight of the membrane and allow for beneficial ventilation. When the spring array of the present invention is inserted into the mattress cavity, the cavity is still relatively hollow and thus allows for beneficial ventilation.

To facilitate ease of construction, limit movement of the sets of springs across the surface of the membrane, and limit the sets of springs from rotating perpendicularly to the membrane once they are mounted through it, a set of one or more mounting pins with corresponding pin receivers are either part of the base of the spring or are used as separate parts to hold the springs together at the desired location on the membrane. These pins mount through one or more holes in the membrane that serve to dictate the location of the sets of springs. The preferred embodiment is to have two mounting holes in the surface of the membrane for each dual spring mounting location and a pin and a receiver on the base of each spring projecting outward from the bottom surface of the spring base. Each spring in a set of springs preferably has one mounting pin inserted through one of the two holes in the membrane and a receiver hole located concentrically to the other hole in the membrane. The mounting pins from each of the pins preferably insert through the membrane and into the receiver hole on the opposing spring in its set. The two pins penetrating through the membrane will act to limit the rotation of the spring set. In other embodiments of the invention the springs that are mounted opposite each other may be divided between male and female springs. The male spring has two mounting pins and the female spring has two receiving holes.

Other features and advantages are inherent in the mattress claimed and disclosed will become apparent to those skilled in the art from the following detailed description and its accompanying drawings.

DETAILED DESCRIPTIONS OF THE DRAWINGS

In the following detailed description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

In the following description, certain terminology is used to describe certain features of one or more embodiments of the invention. For instance "plastic" refers to any natural or synthetic polymer resin such as cellulose, polyethylene or polystyrene. "Foam" refers to any natural, or synthetic soft and supportive padding such as polyurethane foam, foam rubber, or viscoelastic memory foam. Foam can also be made from renewable resources, such as soy, corn, or castor oil.

Figure 1:
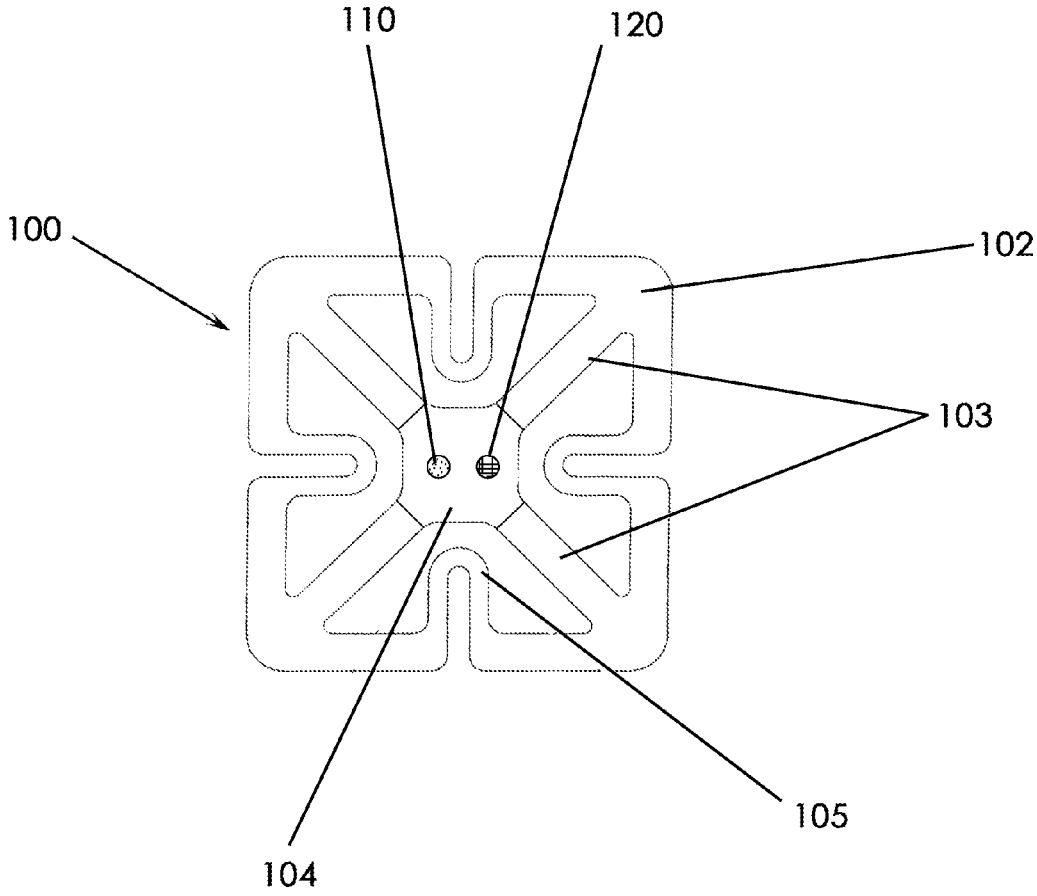
FIG. 1 is a detailed illustration of a top view of one embodiment of a spring.
Figure 2:
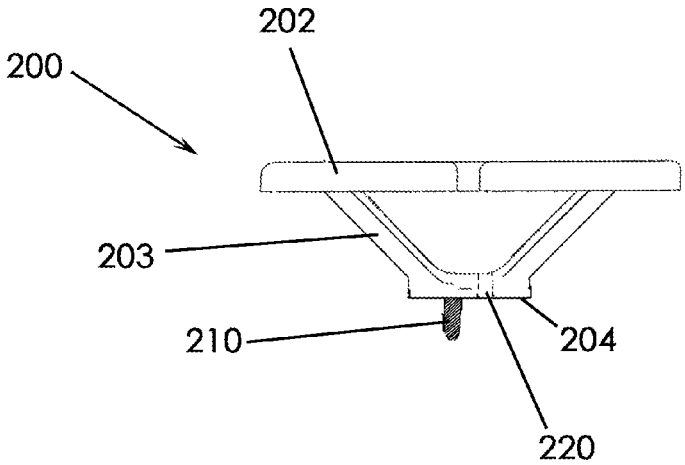
FIG. 2 is a detailed illustration of a side view of one embodiment of a spring.

FIG. 1 is a detailed illustration of a top view of one embodiment of a spring. FIG. 1 shows spring 100 is comprised of a support plate 102, spring arms 103, and a base 104. Preferably, spring 100 will have four spring arms 103, but spring 100 can have a range of spring arms 103, from as few as two to as many as one hundred. Spring 100 functions similar to that of a Belleville type spring that is known to the industry. When compressed this spring 100 annularly spreads, meaning the spring arms 103 deform downward and outward, and the support plate 102 deforms outward. As shown in FIG. 2, the support plate 102 has connection bands 105 that are between the areas where the support plate 102 and the spring arms 103 connect. These connection bands 105 act to limit the deformation of the spring arms 103 by controlling the annular spread of support plate 102. The annular spread can be further controlled by attaching a restraining cross clip to the connection bands 109. This restraining cross clip limits how far apart the connection bands 109 can pull away from each other, and thus makes the mattress firmer. Spring 100, via support plate 102, is preferably in direct contact with a cover layer, top or bottom (as detailed in FIGS. 9 and 10 below). Spring 100 preferably has both a mounting pin 110 and receiving hole 120. However, spring 100 can have multiple mounting pins 110 and receiving holes 120 without departing from the scope of the present invention. Additionally, spring 100 need not have both a receiving hole and a mounting pin, so long as one or the other is present. Spring 100 can be made so that it is either a male spring with mounting pins, but no receiving holes, or a female spring with receiving holes, but no mounting pins. If springs are given a male/female configuration, a male spring would be mounted opposite a female spring.

Figure 3:
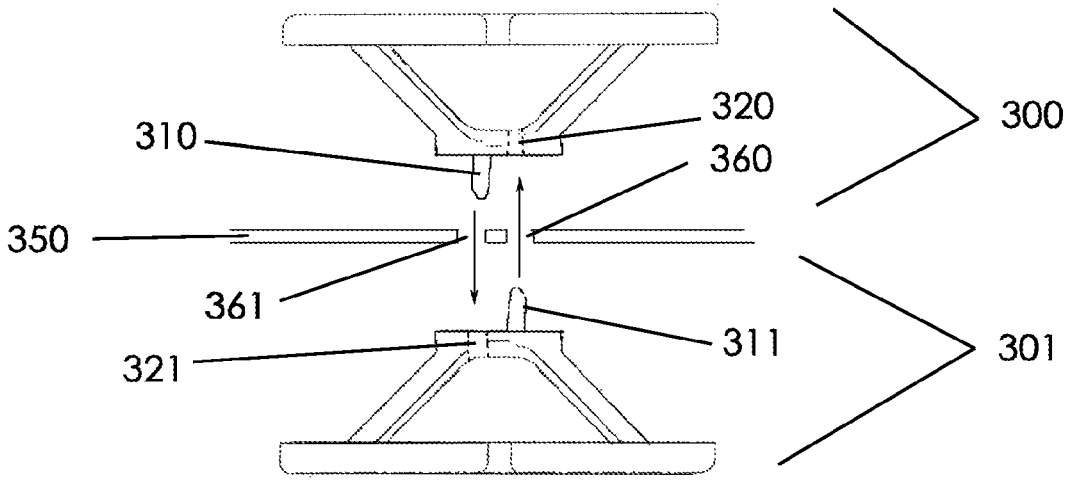
FIG. 3 is a detailed illustration of a side view of two springs about to be mounted on the membrane.

FIG. 2 is a detailed illustration of a side view of one embodiment of a spring. FIG. 3 shows spring 200 is comprised of a support plate 202, spring arms 203, and a base 204. Preferably spring 200 has a mounting pin 210 extending perpendicularly away from base 204. Spring 200 is preferably 13 centimeters in length and width and 10 centimeters in height when uncompressed. However, spring array 200 can range from 3 centimeters in length, width, and height, to 60 centimeters in length, width, and height.

FIG. 3 is a detailed illustration of a side view of two springs about to be mounted on the membrane. FIG. 3 shows two springs 300 and 301 about to be mounted back to back on membrane 350. Preferably membrane 350 has two membrane holes 360 and 361, at each spring mounting location, to allow the mounting pins 310 and 311 of springs 300 and 301 to pierce the membrane. Preferably the mounting pins 310 and 311 also pierce the spring receiving holes 320 and 321. The mounting pins act as insertion or friction snap closures to keep the two springs 300 and 301 mounted securely back to back on the membrane. The pins also act to limit the sets of springs from twisting or rotating perpendicularly along the membrane once they are mounted. Although the mounting pins are preferably an attached extension of the springs 300 and 301, they can be a plurality of separate parts that are individually pushed into the spring receiving holes 320 and 321 and membrane holes 360 and 361 to securely mount the springs 300 and 301 onto the membrane 350. The preferred method of mounting springs to the membrane 350 creates a spring array that is easy, fast, and inexpensive to assemble. The spring mounting pins 310 and 311 easily fit into the opposing spring receiving holes 320 and 321 and the membrane holes 360 and 361 in a one-direction, compressive assembly motion. This allows the spring array of a mattress to be accomplished by laying a series of springs, bottom up, on a table with their mounting pins projecting upward. A pre-hole punched membrane can easily be laid across the series of springs and the spring mounting pins will insert through the membrane holes and mount securely. The opposite side springs can then be mounted in a similar manner. The opposite side spring mounting pins are inserted through the remaining mounting hole at each spring mounting location.

Figure 4:
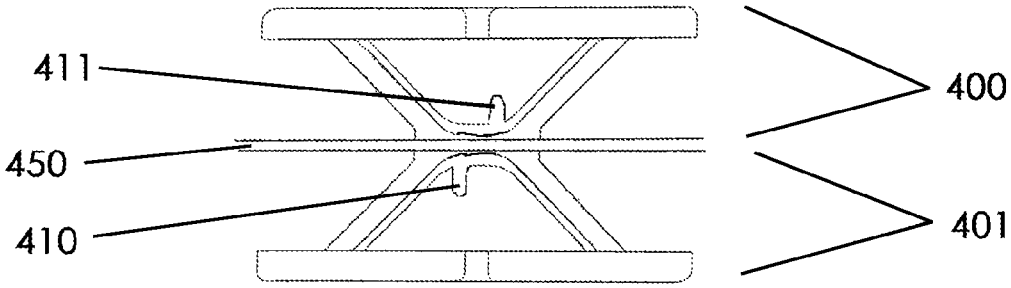
FIG. 4 is a detailed illustration of a side view of two springs mounted on the membrane.

FIG. 4 is a detailed illustration of a side view of two springs mounted on the membrane. FIG. 4 shows two springs 400 and 401 (which are the same as the two springs 300 and 301 shown in FIG. 3) mounted back to back on membrane 450. As shown in FIG. 4, the mounting pin 411 of spring 401 has pierced the membrane 450 and receiving hole of spring 400. Conversely, the mounting pin 410 of spring 400 has pierced the membrane 450 and receiving hole of spring 401. FIG. 4 shows springs 400 and 401 are securely mounted opposite each other on membrane 450 and are prevented from twisting or rotating perpendicularly along the plane of the membrane 450.

Figure 5:
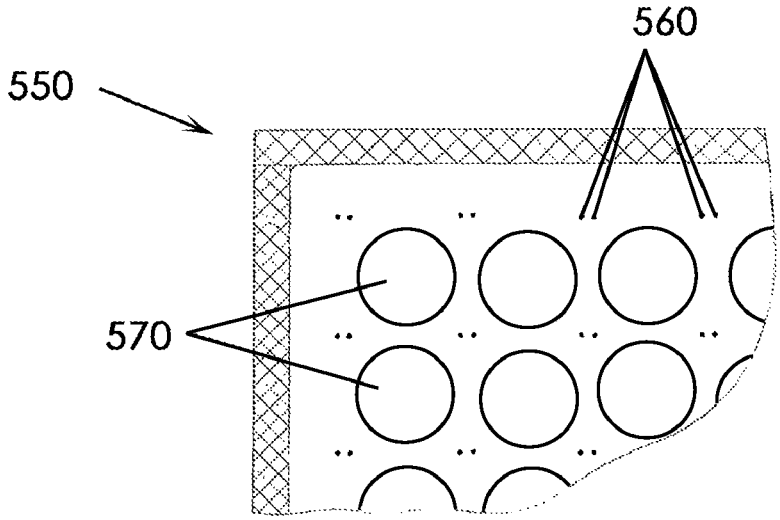
FIG. 5 is an illustration of a top view of one corner of one embodiment of the membrane without springs attached.

FIG. 5 is an illustration of a top view of one corner of one embodiment of the membrane. FIG. 5 shows the entire top side of membrane 550. Preferably, membrane 550 has a plurality of membrane holes 560 that perforate the membrane in sets of two. These sets of membrane holes form the site of the spring mounting locations. FIG. 5 also details that membrane 550 has ventilation apertures 570 that allow for beneficial ventilation in the mattress core and reduced weight of the membrane 550. Preferably the ventilation apertures 570 are placed in a logical and symmetrical pattern amongst the membrane holes 560. However, the ventilation apertures 570 can be placed in a random manner. Ventilation apertures 570 preferably do not intersect the membrane holes 560 and are located far enough away from the membrane holes 560 such that membrane holes 560 are not weakened structurally. As FIG. 5 shows, membrane 550 preferably has one ventilation aperture 570 for every four sets of membrane holes 560. However, the ratio between membrane holes 560 and ventilation apertures 570 can range from having more ventilation apertures 570 then membrane holes 560, or the membrane holes 560 can out number ventilation apertures 570 by as great as fifty to one. As shown in FIG. 5, the ventilation apertures 570 are preferably larger than the membrane holes 560, however, ventilation apertures 570 can be smaller than, or the same size as, the membrane holes 560 without deviating from the scope of the invention. Membrane 550 is preferably made from a thin yet durable layer of plastic, but can be made from any natural or synthetic material such as: metal; metal alloy; wood or other fibrous plant product such as hemp, paper, or cardboard; composite materials such as graphite, fiberglass, boron, or Kevlar®; admixtures of plastic resins combined with metal, metal alloy, wood or other fibrous plant product, or composite materials; reinforced fabric; or any combination of these materials, without departing from the scope of the present invention. Preferably the membrane is flexible, but should resist collapsing across its plane. Preferably membrane 550 is a single layer of contiguous material, but can be made from a plurality of layers, a plurality of conjoined membranes, or both.

Figure 6:
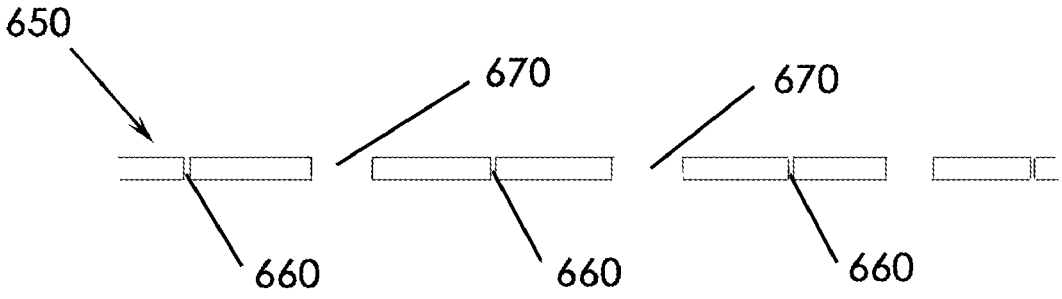
FIG. 6 is an illustration of a cutaway side view of the membrane to show several bisected membrane holes and ventilation apertures.

FIG. 6 is an illustration of a cutaway side view of the membrane and details several bisected membrane holes and ventilation apertures. As shown in FIG. 6, membrane 650 the membrane holes 660 and the ventilation apertures 670 preferably completely perforate the membrane 650. However, it is possible to mount the springs to a membrane whose membrane holes do not completely perforate the membrane without deviating from the scope of the invention.

Figure 7A:
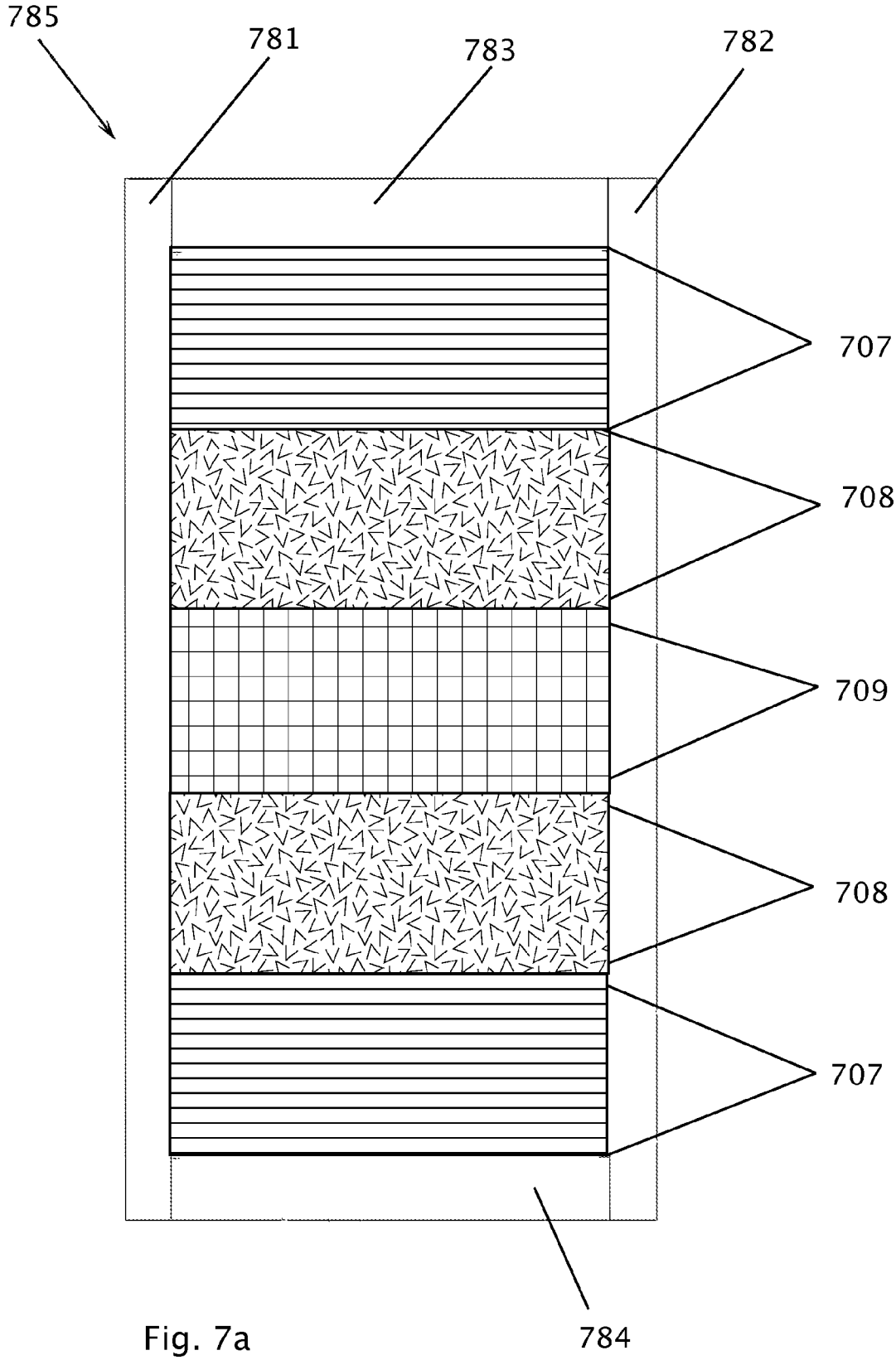
FIG. 7*a* is an illustration of a top view of several sections of one embodiment of the internal spring array to show the varying spring flexibility.

FIG. 7*a* is an illustration of a top view of several sections of one embodiment of the internal spring array to show the varying spring flexibility. FIG. 7*a* details the varying spring flexibility depending on where the springs are located on the membrane. As shown in FIG. 7*a*, mattress 750 preferably has a pattern of varying spring flexibility that is laid out in a symmetrical mirror image. This allows either end of the spring array 785 to act as the head end. FIG. 7*a* shows that spring array 785 has a head end at frame layer 783, and a foot end at frame layer 784. The user's head would rest on frame layer 783 and his or her shoulders would rest on the springs in area 707, which are softer (more flexible) than springs in area 708, which would be beneath the user's back. The springs in area 709 are firmer springs and would support the user's torso. The rest of the spring array 785, which would support the legs, is a mirror image of the head end of the mattress. This way the user can lie with his or her head at either end of the mattress and get the same ergonomic support for his or her back, shoulders and torso. The springs of the spring array can be made stiffer in a variety of ways including, but not limited to, using a less flexible plastic, increasing the density or rigidity of the plastic, by adding restraining cross clips, or by manufacturing a spring with thicker portions.

Figure 7B:
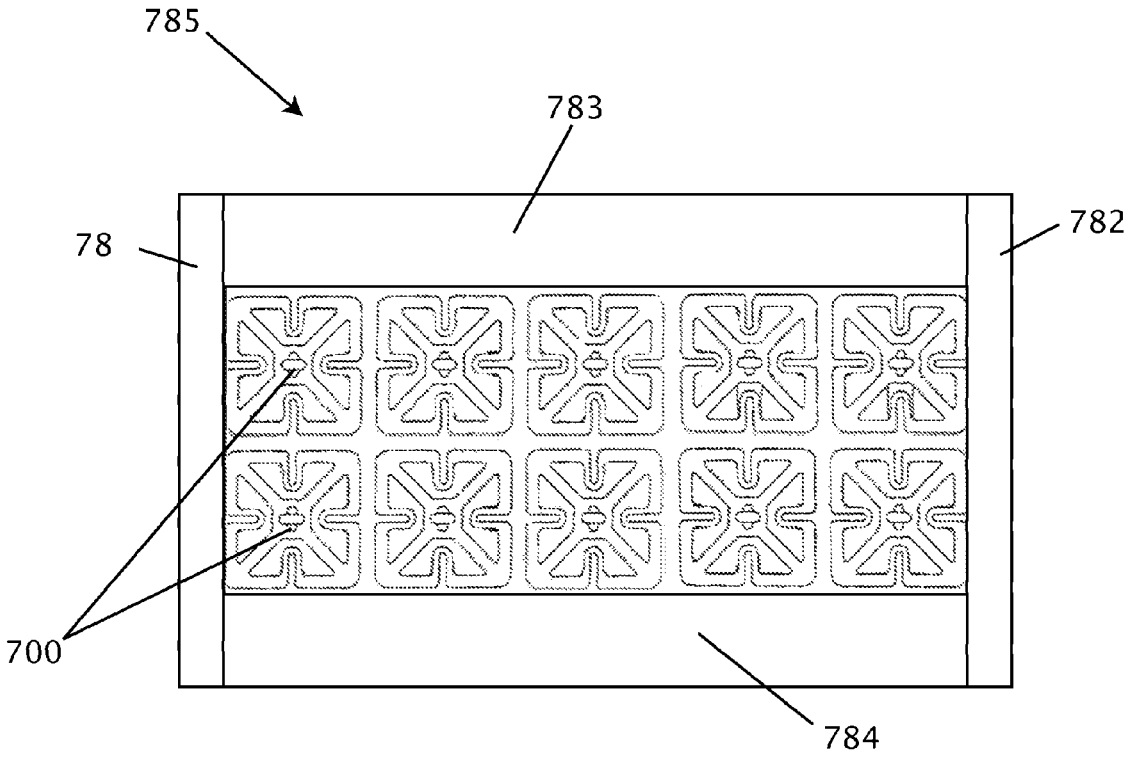
FIG. 7*b* is an illustration of a cutaway top view of one section of one embodiment of the internal spring array.

FIG. 7*b* is an illustration of a cutaway top view of one section of one embodiment of the internal spring array. As shown in FIG. 7*b*, the springs 700 are mounted on the top side of the membrane of internal spring array 785. The springs 700 are preferably arrayed, in an equidistant and symmetrical grid-like pattern, but any equidistant mounted pattern can be used depending on the shape and symmetry of the springs. FIG. 7*b* also shows how the internal spring array 785 is preferably the core of a mattress. As shown in FIG. 7*b*, frame layer 781, 782, 783, and 784 enclose internal spring array 785. However, the frame layer can also enclose only two or three sides without deviating from the present invention.

Figure 8A:
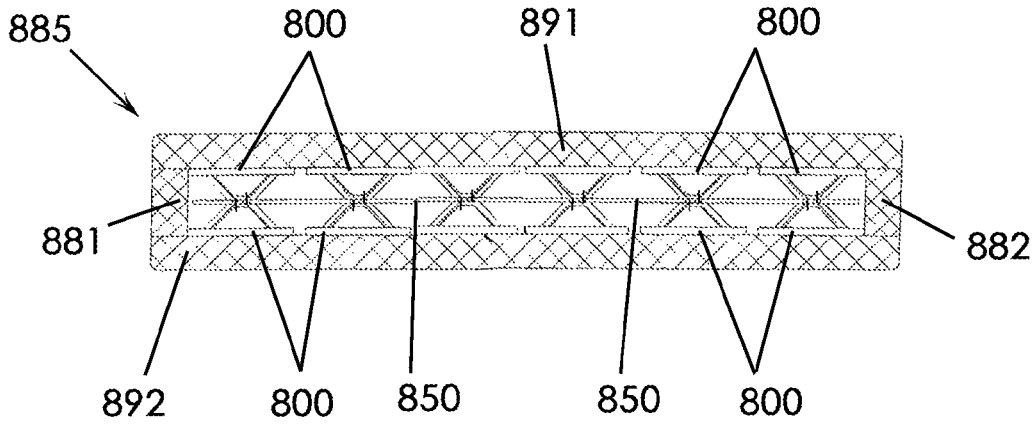
FIG. 8*a* is an illustration of a cutaway side view of one section of one embodiment of the mattress.

FIG. 8*a* is an illustration of a side view of the interior of one embodiment of the mattress. As shown in FIG. 8*a*, internal spring array 885 is the core of mattress 890. Internal spring array 885 preferably has springs 800 mounted linearly in an equidistant manner on the same side of membrane 850, and mounted in a back to back manner on opposite side of membrane 850. As shown in FIG. 8*a*, internal spring array 885 is enclosed by side frame layer 881 and 882 and by top layer 891 and bottom layer 892 (discussed in FIGS. 9 and 10 below).

Figure 8B:
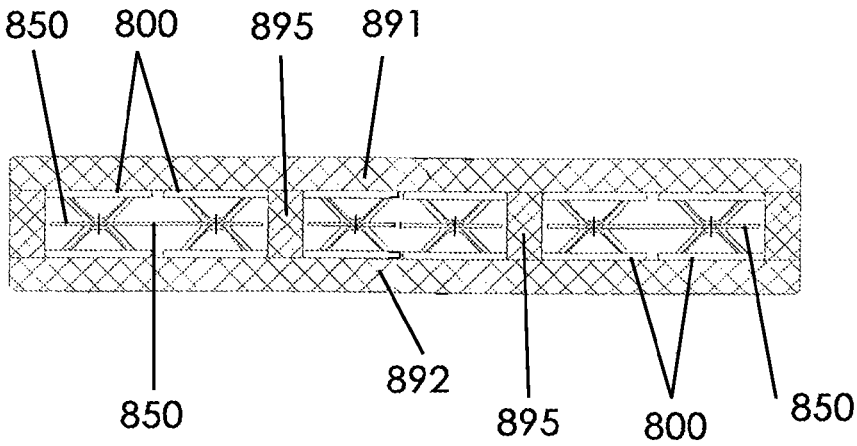
FIG. 8*b* is an illustration of a cutaway side view of one section of one embodiment of the mattress to show the flanges.

FIG. 8*b* is an illustration of a cutaway side view of one section of one embodiment of the mattress and details the flanges. Mattress 890, as shown in FIG. 5, can have flanges 895, which divide mattress 890 into separate recumbence areas 896, 897, and 898. The mattress 890 can be divided latitudinally, longitudinally, or both. The flanges 895 are preferably identical in characteristic and make to frame layer 880, but the flanges may be more rigid (or thicker) or more flexible (or thinner) than frame layer 880 depending on how much support is desired at that location in mattress 890. The separate recumbence areas 896, 897, and 898, preferably provide independent support and flex characteristics because they are divided by the supportive flanges 895, and because the spring arrays 885 inserted into separate recumbence areas 896, 897, and 898 may have springs that differ in their spring flexibility. Thus, recumbence area under the shoulders may be less rigid and the recumbence area under the torso may be more firm. Each of these recumbence areas can be further sub-divided so that specific portions of the recumbence area are stiffer or more giving than the other subdivisions of that recumbence area. Of course, FIG. 8*b* shows just one embodiment of the invention, and there can be more than three recumbence areas, or fewer than three recumbence areas as described.

Figure 9:
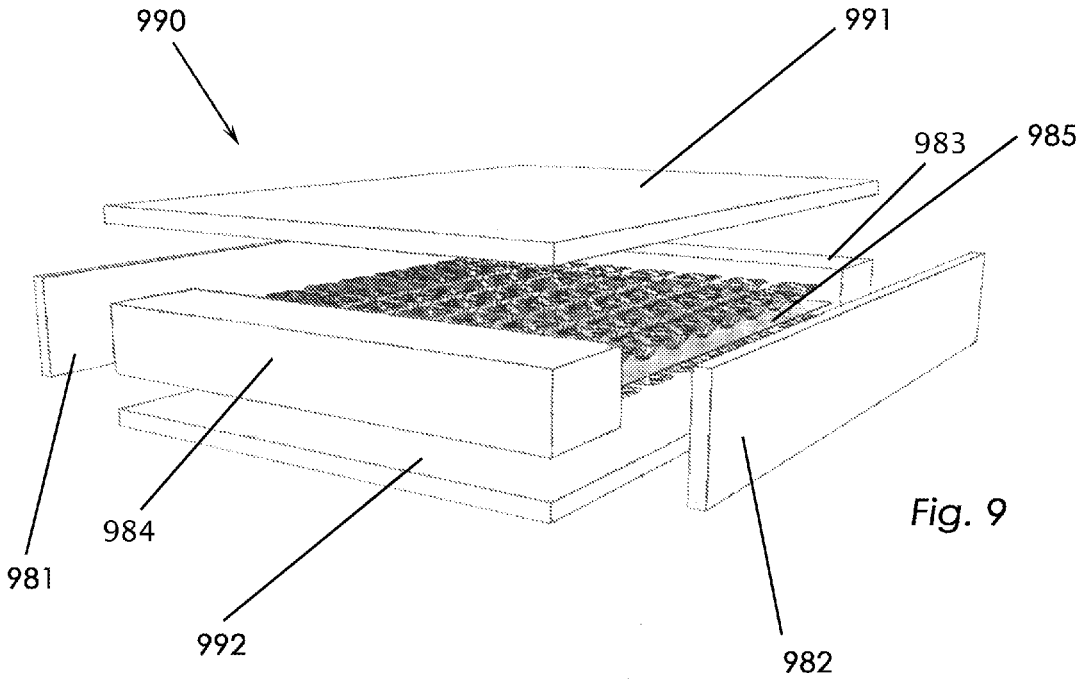
FIG. 9 is a perspective illustration of an exploded view of one embodiment of the mattress.

FIG. 9 is a perspective illustration of an exploded view of one embodiment of the mattress. Mattress 990 in FIG. 9 is shown with a top cover layer 991, a bottom cover layer 992, side frame layer pieces 981 and 982, head and foot frame layer pieces 983 and 984, and internal spring array 985. When the mattresses' parts are fitted together the springs of internal spring array 985 are preferably in flush contact with both top layer 991 and bottom layer 992. When a person lies on mattress 990, pressure is applied to either or both cover layers, and the pressure is transmitted to the springs of the internal spring array 985. The internal spring array 985 responds to the pressure and supports in an ergonomic fashion the body of the person lying down. The top layer 991 and the bottom layer 992, as shown in FIG. 9, are preferably each made of a single layer of foam, but they can be made of any natural or synthetic soft padded or quilted material such cotton, nylon, horse hair, feathers, down, wool, or any combination of these materials. Additionally, top layer 991 and the bottom layer 992 can be made out of any number of layers of foam or padding, from two to two million, and whose thickness can be from 0.01 centimeters to 100 centimeters. As shown in FIG. 9, the framing layer pieces 981, 982, 983, and 984, preferably enclose internal spring array 985 on all sides. However, the frame layer can also enclose only two or three sides without deviating from the present invention. The framing layer provides support on the edges of mattress and holds the internal spring array 985 in the center of mattress 990. The frame layer pieces 981, 982, 983, and 984, preferably are made from foam and are the same height as the spring array, but they can be made out of padded plastic or other soft yet rigid materials or combination of materials that can act to stabilize the edges of mattress 990. Mattress 990 is preferably a standard size mattress, such as a twin, double, queen, king, or California king, but it can be customized to form any size so as to fit any space such as an infant cradle, crib, antique bed, recreational vehicle, boat or yacht, lawn or pool lounging chair, or an entire floor of a room of a home. Mattress 990 can be made with a weather resistant mattress cover that would allow mattress 990 to be suitable for outdoor use.

FIG. 9 also shows that internal spring array 985 can be made from a plurality of springs that are contiguous with, and permanently attached to, the membrane. This type of spring array is preferably manufactured via an injection mold process, but can be manufactured using any means that creates an internal spring array wherein the springs are contiguous with and permanently attached to the membrane. The permanently attached springs of this embodiment of an internal spring array preferably exhibit the same function, form, and spring characteristics as those springs described above. The membrane of this embodiment of an internal spring array preferably exhibits the same function, form, and characteristics as that membrane described above.

Figure 10:
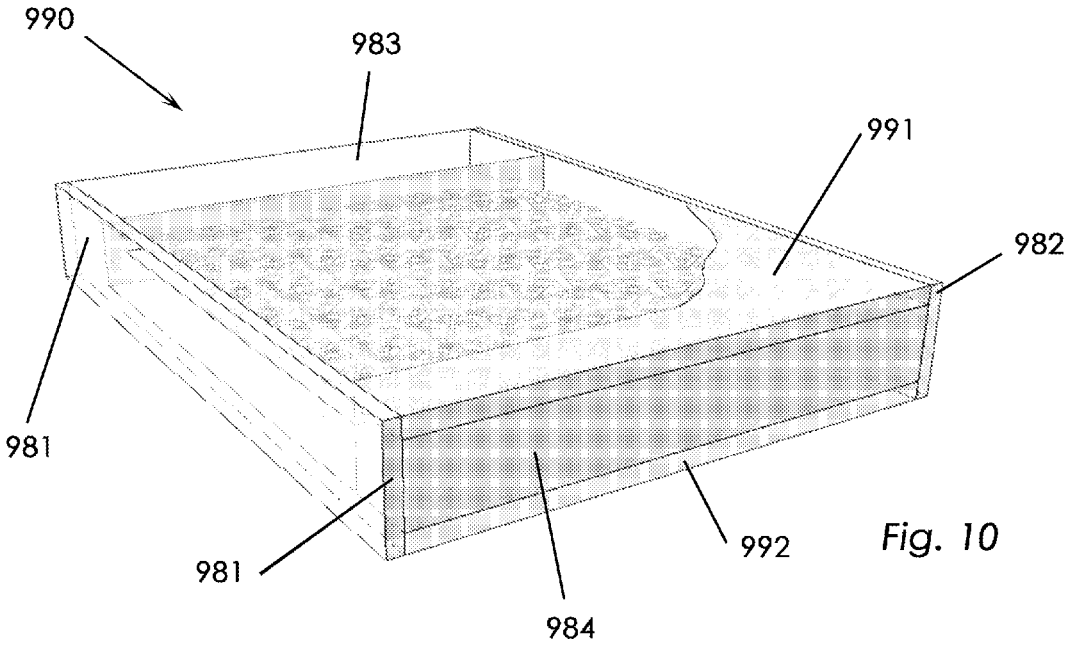
FIG. 10 is a perspective illustration of a cut-away of one embodiment of the mattress.

FIG. 10 is a perspective illustration of a cut-away view of one embodiment the mattress. Mattress 990 in FIG. 10 is shown with a top cover layer 991, a bottom cover layer 992, side frame layer pieces 981 and 982, and head and foot frame layer pieces 983 and 984. Inside mattress 990 is a cavity that contains an internal spring array (as detailed in FIG. 9 above). Although FIG. 10 shows some of the pieces of mattress 990 transparent or translucent, the pieces of mattress 990 are preferably opaque. The transparency or translucency is for illustration purposes.

In summary, the present invention is an internal spring array of a mattress wherein the springs are mounted back to back on a membrane, a method for making an internal spring array of a mattress, and a mattress with two cover layers that enclose an internal spring array wherein the springs are mounted back to back on a membrane and this spring array is surrounded by a frame layer.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. An internal spring array of a mattress, comprising:

a plurality of springs; and a membrane with a plurality of holes;

wherein said plurality of springs are mounted on opposite sides of said membrane such that said opposite mounted springs are mirror images of each other;

wherein said plurality of springs are plastic;

wherein said plurality of springs are comprised of a support plate, a plurality of spring arms, and a base;

wherein said base attaches to said membrane such that said support plate is distal to said membrane;

wherein said plurality of springs annularly spread when pressure is applied to said plurality of springs such that said spring arms deform downward and outward, and the support plate deforms outward;

wherein said plurality of springs have varying spring flexibility dependent on the location of said plurality of springs relative to said membrane;

wherein said plurality of springs are laid out in a pattern of varying spring flexibility;

wherein said plurality of springs further comprise one or more mounting pins that extend from said base;

wherein said plurality of springs are mounted on opposite sides of said membrane when said one or more mounting pins are pushed into said plurality of membrane holes;

wherein said membrane has a plurality of ventilation apertures;

wherein said pattern of varying spring flexibility is laid out in one or more symmetrical mirror image regions along said membrane.

2. An internal spring array of a mattress, comprising:
a plurality of springs; and
a membrane with a plurality of holes;
wherein said plurality of springs are mounted on opposite sides of said membrane such that said opposite mounted springs are mirror images of each other;
wherein said plurality of springs are plastic;
wherein said plurality of springs are comprised of a support plate, a plurality of spring arms, and a base;
wherein said base attaches to said membrane such that said support plate is distal to said membrane;
wherein said plurality of springs annularly spread when pressure is applied to said plurality of springs such that said spring arms deform downward outward, and the support plate deforms outward;
wherein said plurality of springs have varying spring flexibility dependent on the location of said plurality of springs relative to said membrane;
wherein said plurality of springs are laid out in a pattern of varying spring flexibility
wherein said plurality of springs further comprise one or more mounting pins that extend from said base;
wherein said plurality of springs has one or more receiving holes in said base; and
wherein said plurality of springs are mounted on opposite sides of said membrane when said one or more mounting pins are pushed through said plurality of membrane holes and into said one or more receiving holes;
wherein said membrane has a plurality of ventilation apertures;
wherein said pattern of varying spring flexibility is laid out in one or more symmetrical mirror image regions along said membrane.

3. An internal spring array of a mattress, comprising:
a plurality of spring
a membrane with a plurality of holes; and
a plurality of mounting pins;
wherein said plurality of springs are mounted on opposite sides of said membrane such that said opposite mounted springs are mirror images of each other;
wherein said plurality of springs are plastic;
wherein said plurality of springs are comprised of a support plate, a plurality of spring arms, and a base;
wherein said base attaches to said membrane such that said support plate is distal to said membrane;
wherein said plurality of springs annularly spread when pressure is applied to said plurality of springs such that said spring arms deform downward and outward, and the support plate deforms outward;
wherein said plurality of springs have varying spring flexibility dependent on the location of said plurality of springs relative to said membrane;
wherein said plurality of springs are laid out in a pattern of varying spring flexibility;
wherein said plurality of springs has one or more receiving holes in said base; and
wherein said plurality of springs are mounted on said membrane when said mounting pins are pushed through said plurality of membrane holes and into said one or more receiving holes
wherein said membrane has a plurality of ventilation apertures;
wherein said pattern of varying spring flexibility is laid out in one or more symmetrical mirror image regions along said membrane.

4. An internal spring array of a mattress, comprising:
a plurality of spring portions; and
a membrane portion;
wherein said plurality of springs are contiguous with and permanently attached to said membrane portion;
wherein said internal spring array is plastic;
wherein said plurality of spring portions are comprised of a support plate, a plurality of spring arms, and a base;
wherein said plurality of springs are permanently attached on opposite sides of said membrane such that said opposite mounted springs are mirror images of each other, wherein said base attaches to said membrane such that said support plate is distal to said membrane;
wherein said plurality of springs annularly spread when pressure is applied to said plurality of springs such that said spring arms deform downward and outward, and the support plate deforms outward;
wherein said plurality of springs have varying spring flexibility dependent on the location of said plurality of springs relative to said membrane;
wherein said plurality of springs are laid out in a pattern of varying spring flexibility;
wherein said pattern of varying spring flexibility is laid out in one or more symmetrical mirror image regions along said membrane.

5. The internal spring array of claim 4, wherein said membrane portion has a plurality of ventilation apertures.

* * * * *